US006534907B1

(12) United States Patent
Yoshida et al.

(10) Patent No.: US 6,534,907 B1
(45) Date of Patent: Mar. 18, 2003

(54) CATHODE RAY TUBE FACEPLATE HAVING PARTICULAR BLACK MATRIX HOLE TRANSMITTIVITY IN THE PERIPHERAL AREAS

(75) Inventors: Haruhiko Yoshida, Sakura (JP); Hiroshi Yoshioka, Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/236,606

(22) Filed: Jan. 26, 1999

(30) Foreign Application Priority Data

Jan. 30, 1998 (JP) ..... 10-018547

(51) Int. Cl.[7] ..... H01J 31/08; H01J 29/10

(52) U.S. Cl. ..... 313/466; 313/477 R; 313/461

(58) Field of Search ..... 313/461, 464, 313/465, 466, 470, 472, 477 R; 220/2.1 A, 2.3 A

(56) References Cited

U.S. PATENT DOCUMENTS

| | | | | |
|---|---|---|---|---|
| 3,790,839 A | * | 2/1974 | Dietch | 313/472 |
| 3,979,630 A | * | 9/1976 | VanOrmer | 313/408 |
| 4,570,101 A | * | 2/1986 | Campbell | 313/461 |
| 4,590,404 A | | 5/1986 | D'Amato | |
| 4,720,657 A | | 1/1988 | Tischer | |
| 4,904,899 A | * | 2/1990 | Nakata et al. | 313/477 R |
| 5,107,999 A | * | 4/1992 | Canevazzi | 220/2.1 A |
| 5,276,377 A | * | 1/1994 | Van Nes et al. | 313/461 |
| 5,552,663 A | * | 9/1996 | Iida et al. | 313/461 |
| 5,602,442 A | * | 2/1997 | Jeong | 313/466 |
| 6,025,676 A | * | 2/2000 | Ohama et al. | 313/477 R |
| 6,114,803 A | | 9/2000 | Hosotani | |
| 6,140,756 A | | 10/2000 | Hosotani | |
| 6,285,122 B1 | | 9/2001 | Hosotani | |

FOREIGN PATENT DOCUMENTS

| | | |
|---|---|---|
| GB | 1 358 161 | 6/1974 |
| JP | 57-157440 | 9/1982 |
| JP | 61-179042 | 8/1986 |
| JP | 04-284329 | 10/1992 |
| JP | 05-151914 | 6/1993 |
| JP | 06-260113 | 9/1994 |
| JP | 10-223159 | 8/1998 |

* cited by examiner

*Primary Examiner*—Nimeshkumar D. Patel
*Assistant Examiner*—Karabi Guharay
(74) *Attorney, Agent, or Firm*—Antonelli, Terry, Stout & Kraus, LLP

(57) ABSTRACT

A cathode ray tube comprising a panel portion that has a phosphor screen formed over the inner surface of the faceplate 1A. The faceplate 1A is formed such that the radius of curvature Ri of its inner surface 1A1 is almost equal to or larger than the radius of curvature Ro of its outer surface 1A2 and that the black matrix hole transmittivity is defined at a specified level. The cathode ray tube is provided with a simple means which allows the brightness in the peripheral area of the faceplate 1A to match the brightness in the central area and which, even when the deflection angle is large, can reduce the deflection voltage supplied to the deflection yoke and thereby reduce the leakage magnetic field from the deflection yoke.

9 Claims, 7 Drawing Sheets

$Ro \leq Ri + tc$
$ta < tc$

Diagonal direction

Minor axis direction

Diagonal direction

Minor axis direction

CATHODE RAY TUBE FACEPLATE HAVING PARTICULAR BLACK MATRIX HOLE TRANSMITTIVITY IN THE PERIPHERAL AREAS

BACKGROUND OF THE INVENTION

The present invention relates to a cathode ray tube and more specifically to an improvement in the geometry a faceplate's curved surfaces to ensure uniform brightness over an entire image displayed on a phosphor screen formed over the inner surface of the faceplate as an electron beam is projected onto the phosphor screen.

The glass envelope of a cathode ray tube generally comprises a panel portion having a curved faceplate, a neck portion with a reduced diameter, and a funnel portion shaped like a funnel to connect the panel portion and the neck portion. The cathode ray tube further includes a phosphor screen formed over the inner surface of the faceplate, an electron gun installed in the neck portion, and a deflection yoke mounted around the funnel portion. The glass envelope of the cathode ray tube has a near vacuum in its interior and has an atmospheric pressure impressed on its outer side at all times, so that the glass envelope is required to have a mechanical strength higher than a predetermined level. For this reason, various parts of the glass envelope are formed to such thicknesses as will be able to support the corresponding mechanical strengths. In a conventional known cathode ray tube, the faceplate of the glass envelope normally has a construction in which the peripheral area of the faceplate is made thicker than the central area.

FIG. 11 is a cross section showing one example of the construction of the faceplate portion in a glass envelope of a known cathode ray tube.

In FIG. 11, reference number 31 represents a faceplate, 311 denotes an inner surface of the faceplate, 312 denotes an outer surface of the faceplate, tpc a thickness of a central area of the faceplate 31, tpa denotes a thickness of a peripheral area of the faceplate 31, Rpi denotes a radius of curvature of the faceplate's inner surface 311 with the deflection center point O of the electron beam taken as its center, and Rpo denotes a radius of curvature of the faceplate's outer surface 312 with the deflection center point O of the electron beam taken as its center.

As shown in FIG. 11, the faceplate 31 is constructed such that the thickness tpa of the peripheral area is greater than the thickness tpc of the central area to maintain the mechanical strength as described above. As a result, the radius of curvature Rpi of the faceplate's inner surface 311 is smaller than the radius of curvature Rpo of the faceplate's outer surface 312, i.e., tpc<tpa and Rpi<Rpo.

In the above known cathode ray tube, the thickness tpc of the central area of the faceplate 31 is small and the thickness tpa of the peripheral area is large, so that when an image is displayed on the phosphor screen, light radiated outwardly from the phosphor screen through the faceplate 31 becomes attenuated more in the peripheral area of the faceplate 31 with a large thickness tpa than in the central area with a small thickness tpc. That is, if we let Tpc stand for the light transmittivity in the central area of the faceplate 31 and Tpa represents the light transmittivity in the peripheral area, then Tpc>Tpa and the brightness of the displayed image is lower in the peripheral area of the faceplate 31 than in the central area, giving rise to a problem that the brightness of a displayed image cannot be maintained at a sufficient level in the peripheral area. The luminance in the peripheral area is further degraded by the fact that the weight of the phosphor is smaller in the peripheral area than in the central area.

To correct the brightness of a displayed image in the peripheral area of the faceplate 31 to match the brightness in the central area when the displayed image in the peripheral area is dark compared with that in the central area, the intensity of the electron beam projected onto the peripheral area of the phosphor screen needs to be set stronger than that of the central area. Such a means for correcting the electron beam intensity, however, cannot easily be obtained.

In general cathode ray tubes, a deflection voltage applied to the deflection yoke is set as small as possible to minimize the leakage magnetic field from the deflection yoke. In recent years, however, a growing number of cathode ray tubes with an increased deflection angle have come into use. Because the deflection voltage supplied to the deflection yoke of the cathode ray tube increases with the deflection angle, it is difficult to reduce the deflection voltage applied to the deflection yoke, giving rise to the problem that the leakage magnetic field from the deflection yoke cannot be reduced.

The present invention has been accomplished to overcome the above mentioned problem and its objective is to provide a cathode ray tube which can match the brightness of a displayed image in the peripheral area of the faceplate to that of the central area with a simple means.

Another object of this invention is to provide a cathode ray tube which, even when the deflection angle is large, can reduce the deflection voltage applied to the deflection yoke and therefore reduce the leakage magnetic field from the deflection yoke.

SUMMARY OF THE INVENTION

To achieve the above objective, the cathode ray tube of this invention has the faceplate's curved surfaces configured so that the radius of curvature of the faceplate's inner surface is equal to or larger than that of the faceplate's outer surface and that the black matrix hole transmittivity is defined in a predetermined range.

With the above means, because the faceplate's curved surfaces are so configured that the radius of curvature of its inner surface is larger than that of its outer surface, the difference in thickness between the central area of the faceplate and the peripheral area becomes small and the central area is slightly thicker than the peripheral area, with the result that the brightness of the displayed image in the peripheral area of the faceplate matches that of the central area. This eliminates the need to increase the black matrix hole transmittivity excessively in the peripheral area of the screen, making it possible to provide a cathode ray tube with good color purity without significantly degrading the resolution in the peripheral area of the screen.

Further, with the above means, the geometry of the faceplate curved surfaces is such that the radius of curvature of the inner surface of the panel portion's faceplate is greater than the corresponding radius of curvature of the known cathode ray tube and therefore the distance from the deflection center of the electron beam to the peripheral area of the phosphor screen formed over the inner surface of the faceplate is longer than the corresponding distance of the known cathode ray tube. To the that extent the radius of curvature is longer, the deflection angle of the electron beam at the deflection yoke is reduced, which in turn reduces the deflection voltage applied to the deflection yoke and therefore reduces the leakage magnetic field from the deflection yoke.

DESCRIPTION OF THE PREFERRED EMBODIMENTS

Figure 1:
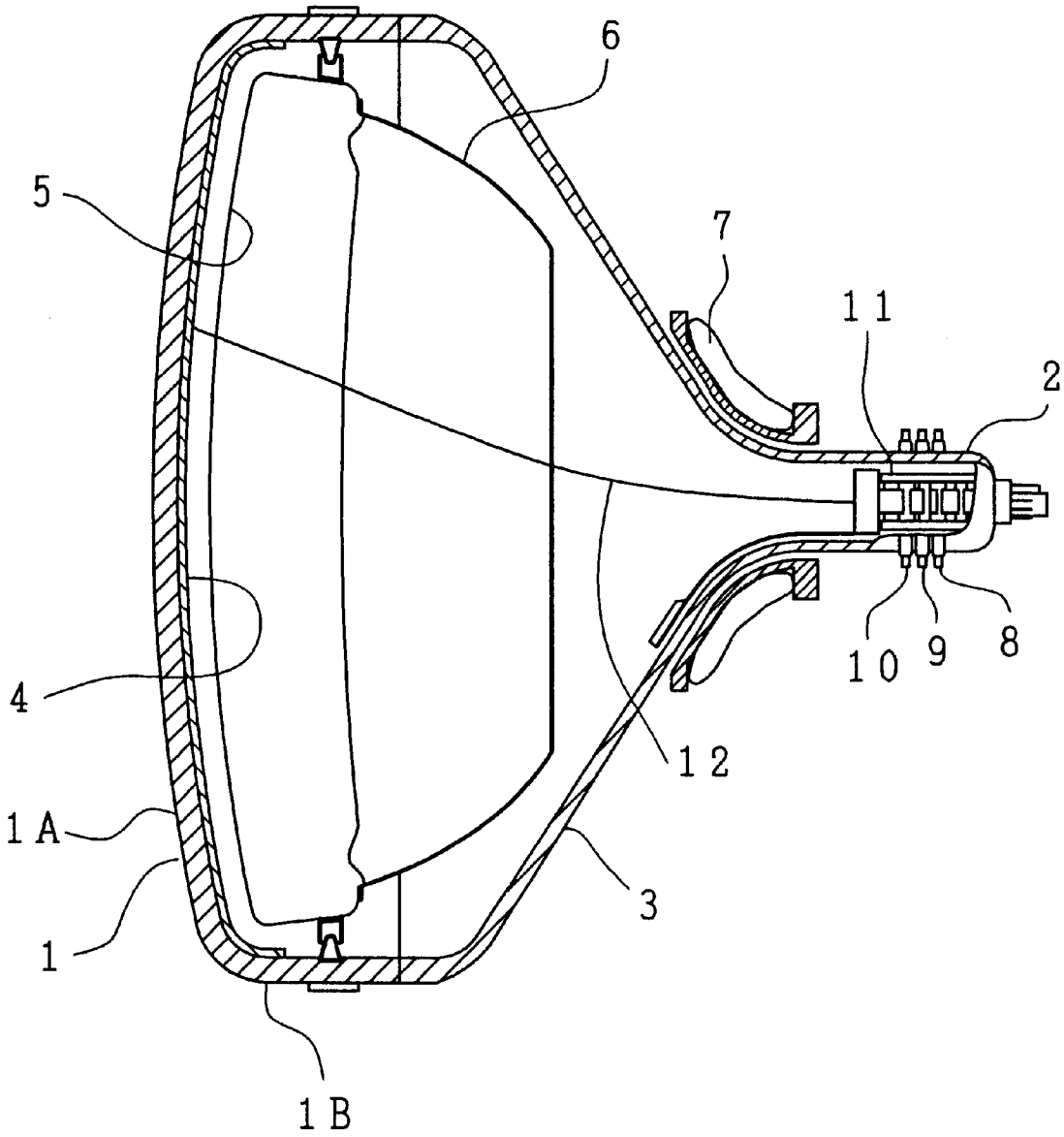
FIG. 1 is a cross section showing an example of the construction of one embodiment of the cathode ray tube according to this invention.

In one embodiment of this invention, the cathode ray tube comprises a panel portion having a phosphor screen formed over the inner surface of a curved faceplate; a neck portion accommodating an electron gun for projecting an electron beam toward the phosphor screen; and a funnel portion for connecting the panel portion and the neck portion and having a deflection yoke mounted on the outer circumference thereof. The geometry of the curved faceplate is such that the radius of curvature of its inner surface is equal to or larger than that of its outer surface.

According to one embodiment of this invention, because the curved surfaces of the faceplate of the cathode ray tube are so configured that the radius of curvature of the inner surface is almost equal to or greater than that of the outer surface, the peripheral areas of the faceplate are equal to or slightly larger in thickness than the central area. As a result, the brightness of a displayed image in the peripheral areas of the faceplate can be increased to a level close to the brightness of a displayed image in the central area of the faceplate.

Further, according to one embodiment of this invention, because the radius of curvature of the inner surface of the faceplate of the panel portion is larger than the corresponding radius of curvature of the faceplate in known cathode ray tube, the distance from the deflection center of an electron beam to the peripheral areas of the phosphor screen formed over the inner surface of the faceplate is slightly longer than the corresponding distance in the known cathode ray tube. To the extent that the distance to the peripheral areas is extended, the deflection angle of the electron beam at the deflection yoke is reduced, making it possible to reduce the deflection voltage applied to the deflection yoke and therefore to reduce the amount of magnetic field leaking from the deflection yoke.

In more concrete terms, the cathode ray tube of this invention has the following features.

(1) When RDI and RDO denote equivalent radii of curvature of the inner and outer surfaces, respectively, of the faceplate portion that connect the central area of the screen and the peripheral areas in the diagonal direction (the diagonal direction peripheral areas) of the screen and tc denotes the thickness of the panel portion at the central area of the screen, the following relationship holds:

$$RDO-tc<RDI$$

The black matrix hole transmittivity in the diagonal direction peripheral areas of the screen is equal to or less than 110% of that of the central area.

(2) When RHI and RHO denote equivalent radii of curvature of the inner and outer surfaces, respectively, of the faceplate portion that connect the central area of the screen and the peripheral areas in the major axis direction (the major axis direction peripheral areas) of the screen and tc denote thickness of the panel portion in the central area of the screen, the relation RHO−tc<RHI holds and the black matrix hole transmittivity in the peripheral areas in the major axis direction of the screen is equal to or less than 110% of that of the central area.

(3) When RDI and RDO denote equivalent radii of curvature of the inner and outer surfaces, respectively, of the faceplate portion that connect the central area of the screen and the diagonal direction peripheral areas of the screen and tc denotes the thickness of the panel portion in the central area of the screen, the relation RDO−tc≈RDI holds and the black matrix hole transmittivity in the diagonal direction peripheral areas of the screen is between 70% and 110% of that of the central area.

(4) The outer surface of the faceplate portion is flat, the glass thickness of the panel portion in the diagonal direction peripheral areas of the screen is smaller than that of the central area of the screen, and the black matrix hole transmittivity in the diagonal direction peripheral areas of the screen is equal to or less than 110% of that of the central area.

(5) The inner surface of the faceplate portion is flat, the glass thickness of the panel portion in the diagonal direction peripheral areas of the screen is smaller than that of the central area of the screen, and the black matrix hole transmittivity in the diagonal direction peripheral areas is equal to or less than 110% of the central area of the screen.

(6) A shadow mask is provided inside the panel portion facing the phosphor screen, the phosphor screen is formed of a plurality of phosphor pixels enclosed by a black matrix, the faceplate portion is aspherical on its outer surface, and the glass thickness of the faceplate portion is smaller in the diagonal direction peripheral areas of the phosphor screen than in the central area.

(7) The faceplate portion is aspherical on its inner surface, and the glass thickness of the faceplate portion is smaller in the diagonal direction peripheral areas of the phosphor screen than in the central area.

(8) The phosphor screen is formed of phosphor dot trios of three colors each, enclosed by a black matrix, each of which corresponds to each set of three electron beams. The phosphor dot trios are arranged at intervals of 0.26 mm or less in the central area of the phosphor screen. The glass thickness of the faceplate portion is smaller in the diagonal direction peripheral areas of the phosphor screen than in the central area.

At least one of the above features (1)–(8) may be combined with at least one of the following features to produce more excellent effects.

(9) The black matrix hole transmittivity in the diagonal direction peripheral areas of the screen is smaller than that in the central area.

(10) The black matrix hole transmittivity in the peripheral areas in the major axis direction of the screen is smaller than that in the central area.

(11) If we let the equivalent radii of curvature of the inner and outer surfaces of the faceplate portion that connect the central area of the screen and the peripheral areas in the minor axis direction (the minor axis direction peripheral areas) of the screen be RVI and RVO, respectively, and the thickness of the panel portion in the central area of the screen be tc, then the relation RVO−tc≧RVI holds.

(12) The light transmittivity of the material of the panel portion is almost equal to that of a tint.

(13) The light transmittivity of the material of the panel portion is almost equal to that of a dark tint.

(14) The screen has a diagonal size of about 46 cm or larger.

(15) The dot pitch in the central area of the screen is about 0.26 mm or less.

(16) The deflection angle is approximately 100° or greater.

(17) The shadow mask transmittivity in the diagonal direction peripheral areas of the screen is 110% or less of the shadow mask transmittivity in the central area.

(18) The shadow mask transmittivity in the diagonal direction peripheral areas of the screen is smaller than that of the central area.

(19) The dot pitch in the diagonal direction peripheral areas of the screen is 100% or less of that of the central area.

(20) The dot pitch in the diagonal direction peripheral areas of the screen is 105% or less of that of the central area.

(21) The black matrix hole transmittivity in the diagonal direction peripheral areas is between 90% and 110% of that of the central area.

(22) The thickness of the panel portion in the peripheral areas in the minor axis direction of the screen is equal to or larger than that of the central area.

Now, various embodiments of this invention will be described with reference to the accompanying drawings.

FIG. 1 is a cross section showing an example of the structure of one embodiment of the cathode ray tube according to this invention.

In FIG. 1, reference numeral 1 represents a panel portion, 1A denotes a faceplate, 1B denotes panel skirt portion, 2 denotes a neck portion, 3 denotes a funnel portion, 4 denotes a phosphor layer, 5 denotes a shadow mask, 6 denotes an internal magnetic shield, 7 denotes a deflection yoke, 8 denotes a purity adjust magnet, 9 denotes a center beam static convergence adjust magnet, 10 denotes a side beam static convergence adjust magnet, 11 denotes an electron gun, and 12 denotes an electron beam.

A glass envelope (bulb) forming the color cathode ray tube comprises the large-diameter panel portion 1 arranged on the front side, the narrow neck portion 2 housing the electron gun 11 therein, and the funnel-shaped funnel portion 3 connecting the panel portion 1 and the neck portion 2. The panel portion 1 has the faceplate 1A at the front and the skirt portion 1B connected to the funnel portion, with the phosphor layer 4 formed on the, inner surface of the faceplate 1A and with the shadow mask 5 disposed to face the phosphor layer 4. An internal magnetic shield 6 is provided inside a connecting region of the panel portion 1 and the funnel portion 3. The deflection yoke 7 is disposed on the outer side of a connecting region of the funnel portion 3 and the neck portion 2 during use. Three electron beams 12 (only one beam is shown) emitted from the electron gun 11 are deflected in a predetermined direction by the deflection yoke 7 and impinge on the phosphor layer 4 through the shadow mask 5. Arranged side by side on the outer side of the neck portion 2 are the purity adjust magnet 8, the center beam static convergence adjust magnet 9 and the side beam static convergence adjust magnet 10.

The operation, i.e., the image display operation, of a color cathode ray tube having the above construction is similar to that of the known color cathode ray tube, and therefore its explanation is not given here.

Figure 2:
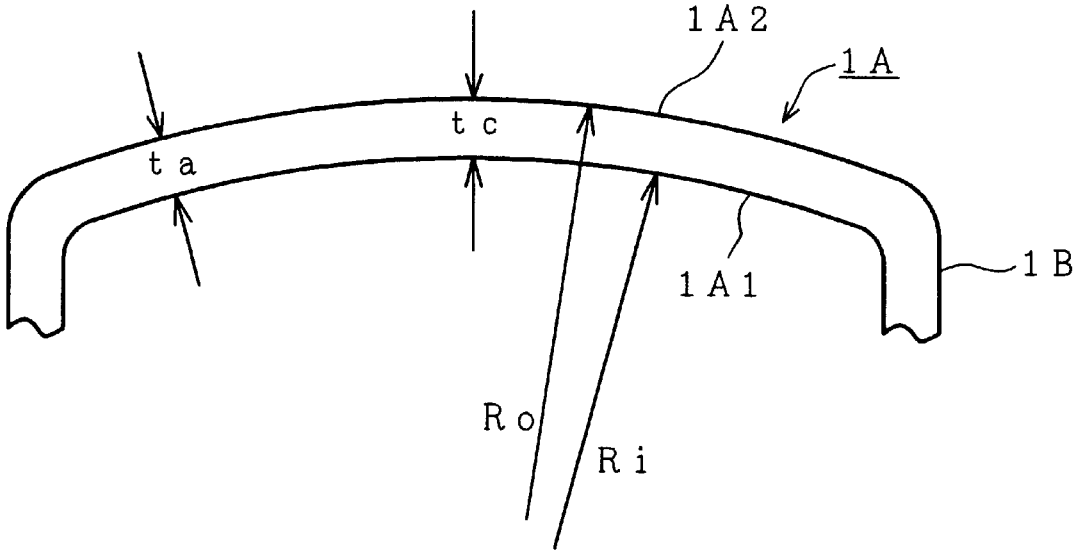
FIG. 2 is a cross section of one embodiment of a panel faceplate according to this invention.

Next, FIG. 2 is a cross section showing the structure of the faceplate 1A of the panel portion 1 in the embodiment of the color cathode ray tube shown in FIG. 1.

In FIG. 2, reference numeral 1A1 denotes a faceplate inner surface, 1A2 denotes a faceplate outer surface, tc denotes a thickness of a central part of the faceplate 1A, ta denotes a thickness of a peripheral part of the faceplate 1A, Ri denotes a radius of curvature of the faceplate inner surface 1A1, and Ro denotes a radius of curvature of the faceplate outer surface 1A2. Other constitutional elements identical to those shown in FIG. 1 are assigned like reference numerals. The thicknesses tc and ta of the central part and peripheral part of the faceplate 1A represent the shortest distances between the faceplate inner surface 1A1 and the faceplate outer surface 1A2 at the respective parts. Because the radius of curvature of the faceplate, either of the inner surface or outer surface, is usually far greater than the thickness of the faceplate, the thickness ta of the peripheral part of the faceplate 1A may be replaced with a distance between the inner surface 1A1 and the outer surface 1A2 of the faceplate that are parallel to the tube axis direction.

Figure 3:
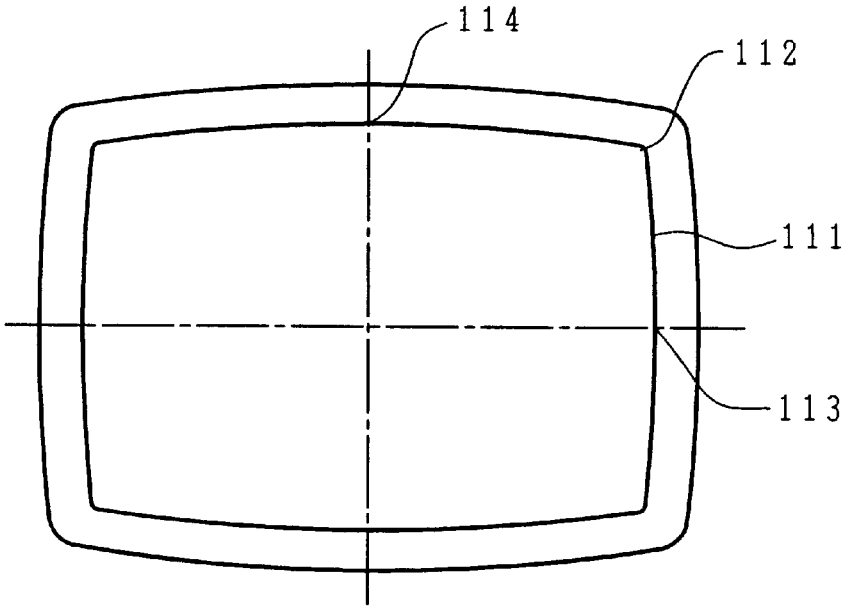
FIG. 3 is a plan view of the panel for explaining the invention.

As shown in FIG. 2, the faceplate 1A of this embodiment is so configured that the relation between the radius of curvature Ri of the faceplate inner surface 1A1 and the radius of curvature of the faceplate outer surface 1A2 is Ro≦Ri+tc and that the thickness ta of the peripheral part of the faceplate is nearly equal to or less than the thickness tc of the central part. The peripheral part of the faceplate, as shown in FIG. 3, represents a peripheral region which surrounds an area covered with the phosphor dots or stripes of the phosphor layer 4 formed on the faceplate inner surface 1A1 or an effective screen 111 where an image is displayed.

The faceplate 1A of the panel portion 1 of this embodiment is designed by the following procedure.

First, in step S1, the radius of curvature Ro of the faceplate outer surface 1A2 of the faceplate 1A is set.

Next, in step S2, the thickness tc of the central part of the faceplate 1A is set.

Then, in step S3, the thickness ta of the peripheral part of the faceplate 1A is set equal to or smaller than the thickness tc of the central part that was set in step S2.

In step S4, the radius of curvature Ri of the faceplate inner surface 1A1 is set so that it will satisfy the thickness tc of the central part and the thickness ta of the peripheral part, both of which were set at steps S2 and S3.

In step S5, a predetermined computation of strength is carried out for the faceplate 1A of the panel portion 1 that has the radii of curvature Ri and Ro of the faceplate inner and outer surfaces 1A1 and 1A2 which were set in the preceding steps S4 and S1, respectively.

Next, in step S6, when it is decided that the result of the strength computation performed by the preceding step S5 exceeds a predetermined value, the design of the faceplate 1A of the panel portion 1 having the radii of curvature Ri and Ro of the faceplate inner and outer surfaces 1A1 and 1A2 is terminated. When on the other hand it is decided that the calculated result is below the predetermined value, the processing returns to the step S3, from which the processing is performed again.

In the color cathode ray tube with the faceplate 1A of the panel portion 1 configured in this way, because the thickness ta of the peripheral part of the faceplate 1A is set nearly equal to or smaller than the thickness tc of the central part, the light transmittivity in the peripheral area of the screen can be made nearly equal to or larger than that of the central area of the screen and thus the brightness of the whole screen can be made uniform.

Figure 4:
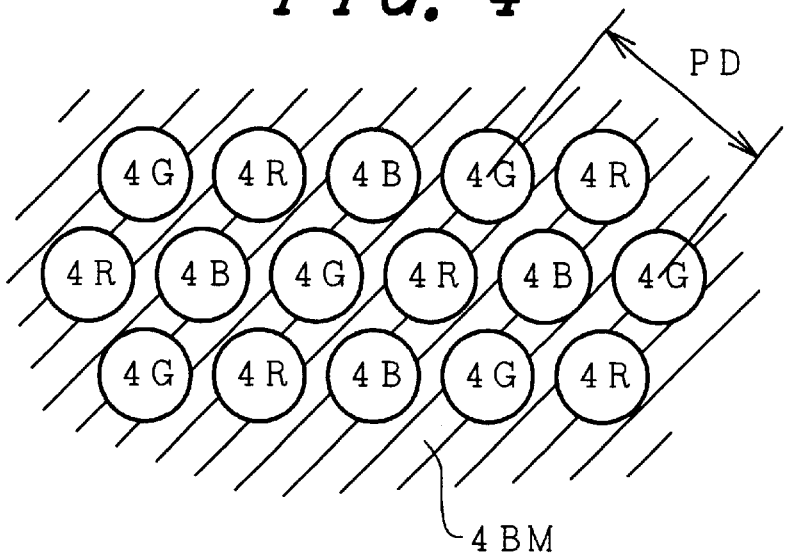
FIG. 4 is an explanatory diagram of a dot type black matrix.
Figure 5:
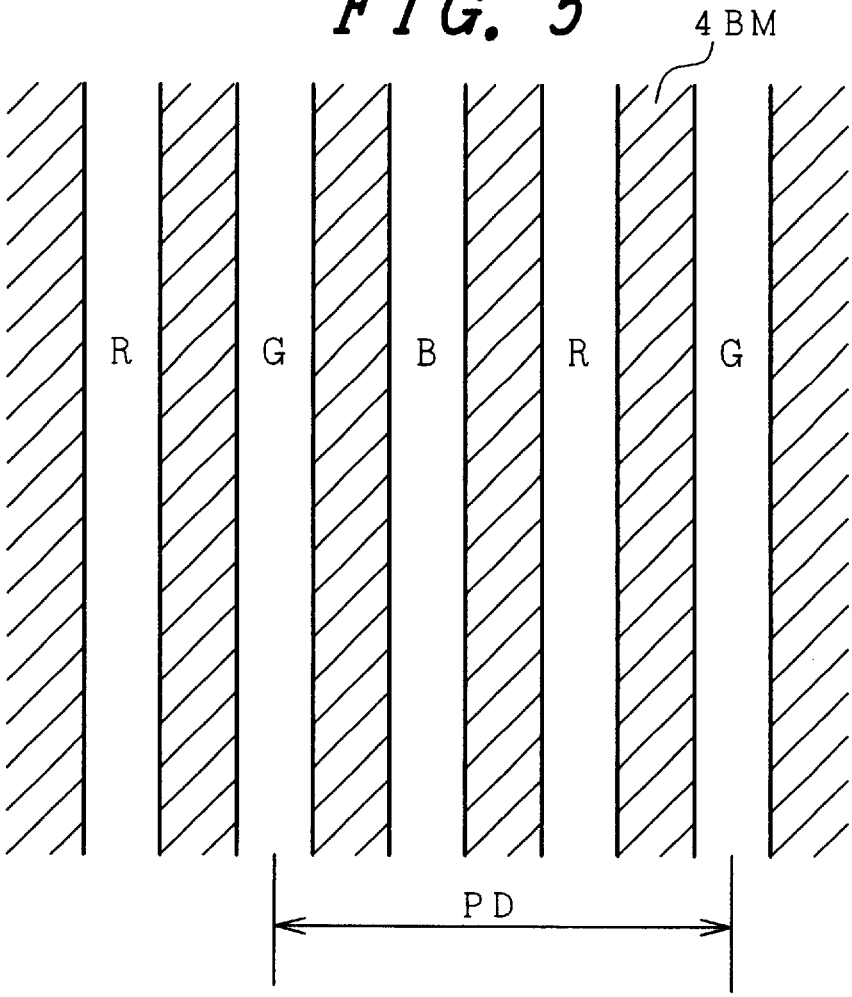
FIG. 5 is an explanatory diagram of a stripe type black matrix.
Figure 6:
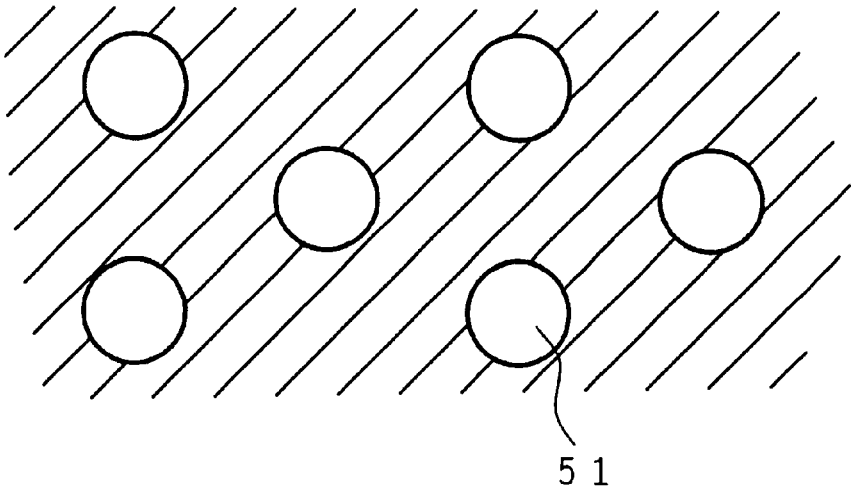
FIG. 6 is an explanatory diagram of a dot type shadow mask.

As a means for compensating for the luminance difference between the central part and the peripheral part, a method may be conceived that sets the black matrix hole transmittivity higher in the peripheral area than in the central area. The black matrix hole transmittivity refers to a percentage of the area where a graphite layer 4BM is not provided, i.e., a percentage of the amount of light that can pass through, as shown in FIG. 4. PD represents a dot pitch or an interval between phosphors of the same color. FIG. 5 shows a stripe type phosphor screen. With a conventional panel whose glass thickness is larger in the peripheral area than in the central area, the brightness of the central and peripheral areas cannot easily be made uniform without setting the black matrix hole transmittivity in the peripheral area more than 10% higher than that of the central area. The method of increasing the black matrix hole transmittivity in the peripheral area of the screen without sacrificing the landing margin includes one that makes the dot pitch larger in the peripheral area of the screen than in the central area. Increasing the dot pitch in the peripheral area too much, however, will degrade the resolution in the area. Further, an increased hole transmittivity in the peripheral area will result in a loss of beam, a phenomenon in which the electron beam fails to cover the hole portions, because the electron beam that has passed through the shadow mask perforations cannot be made sufficiently larger than the black matrix holes. To prevent this, the transmittivity of the shadow mask may be raised, which, however, gives rise to a problem of reduced strength of the shadow mask. The transmittivity of the shadow mask refers, as shown in FIG. 6, to a percentage of the area of shadow mask perforations 51.

This invention sets the panel thickness in the panel peripheral area equal to that in the central area and defines the black matrix hole transmittivity in connection with the panel thickness, thereby minimizing the luminance difference between the central area and the peripheral area of the screen while securing the landing margin.

Even when the central and peripheral areas of the screen are made equal in the panel thickness and also in the black matrix hole transmittivity, the brightness of the peripheral area is lower than that of the central area for the reasons that (1) the weight of the phosphor is smaller in the peripheral area than in the central area and that (2) the reflectivity of a metal backing that reflects light from the phosphors is degraded in the peripheral area of the screen. Hence, there may be a need to increase the black matrix hole transmittivity in the peripheral area even when the peripheral area has a slightly reduced panel thickness. Even in this case, this invention allows the black matrix hole transmittivity in the peripheral area of the screen to be set at 110% or less of that of the central area and, depending on the magnitudes of the panel thickness and the luminance difference, even at 105% or below. The most preferred embodiment of this invention is to set the black matrix hole transmittivity lower in the peripheral area than in the central area. The brightness ratio of the peripheral area to the central area of the screen can be further improved if the black matrix hole transmittivity in the peripheral area is set at 70% or higher with respect to the central area of the screen. Still further improvement can be obtained by setting the peripheral-to-central-area ratio of the black matrix hole transmittivity at 90% or higher. This eliminates the luminance difference between the central area and the peripheral area and also secures the necessary landing margin in the peripheral area. If the black matrix hole transmittivity in the peripheral area is 110% or lower of that of the central area, the dot pitch in the peripheral area can also be set to 110% or lower of that of the central area, so that degradation in resolution in the peripheral area of the screen does not show very conspicuously. Similarly, if the black matrix hole transmittivity in the peripheral area of the screen is 105% or less of that in the central area, the dot pitch in the peripheral area can also be set to 105% or less of that in the central area, so that the degradation of the resolution in the peripheral area hardly shows. Further, because the transmittivity of the shadow mask does not need to be raised excessively in the peripheral area or it can be made small in the peripheral area, the strength of the shadow mask can be secured.

When the black matrix hole transmittivity in the peripheral area is 110% or less of that of the central area, the transmittivity of the shadow mask in the peripheral area can also be held at 110% or less of that of the central area. Considering the margin of the shadow mask strength, it is preferred that the shadow mask transmittivity in the peripheral area be lower than that of the central area.

The peripheral area of the effective screen, as shown in FIG. 3, can be represented by the diagonal direction peripheral areas 112, the major-axis direction peripheral areas 113, and the minor-axis direction peripheral areas 114. In general, the areas where the luminance difference with respect to the central area becomes most critical are the diagonal direction peripheral areas 112. They are followed by the major-axis direction peripheral areas 113 and then the minor-axis direction peripheral areas 114. In practice, the panel thickness, black matrix hole transmittivity and shadow mask transmittivity in various parts of the panel need only to be set according to the requirements of brightness distribution of a product.

In a color display tube (CDT) or the like used in a computer terminal, a so-called tint (10.6 mm thick with a transmittivity of 56.8% in terms of the EIAJ standard transmittivity using light with a wavelength of 546 nm) is often used in the panel glass to increase contrast. For higher contrast, a dark tint (10.6 mm thick with a transmittivity of 46% in terms of the EIAJ standard transmittivity using light with a wavelength of 546 nm) is used frequently. This invention is particularly effective when glasses with such low transmittivities are used.

In a high resolution tube with a dot pitch of 0.25 mm or less in the central area, the margin with which the electron beam lands on the phosphors is small in the peripheral area of the screen, making it difficult to increase the black matrix hole transmittivity in the peripheral area. Therefore, this invention is particularly effective for such CDTs.

The luminance difference between the central area and the peripheral area of the screen is more likely to show with large tubes. This invention is particularly effective for large CDTs of 19" or greater.

An example of the application of this invention to a 19" CDT (with an effective screen diagonal size of 46 cm) is shown. In this case, the panel base has a tint.

| | Central area | Diagonal peripheral area |
|---|---|---|
| Panel thickness | 12.5 mm | 11.3 mm |
| Black matrix hole transmittivity | 42.4% | 39.8% |

-continued

| | Central area | Diagonal peripheral area |
|---|---|---|
| Shadow mask transmittivity | 17.6% | 17.1% |
| Dot pitch | 0.26 mm | 0.27 mm |

Figure 7:
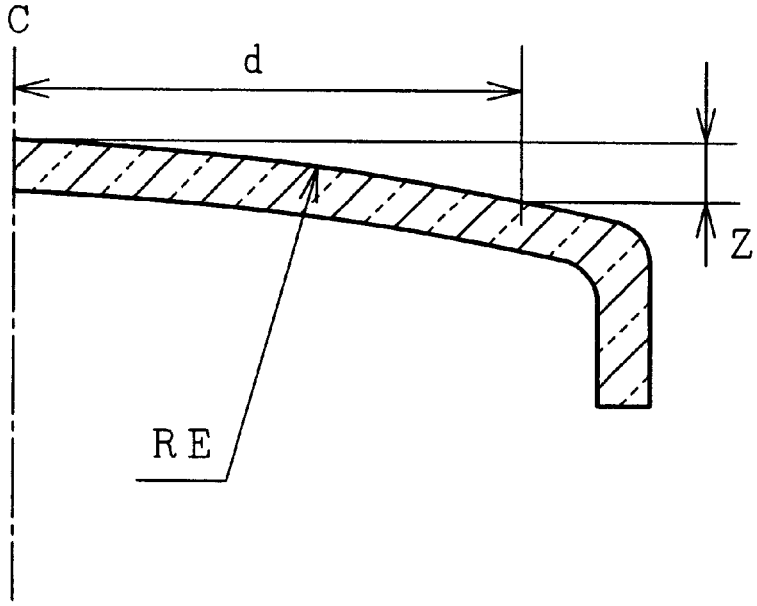
FIG. 7 is a diagram showing an equivalent radius of curvature when the panel face portion is an aspherical surface.

While the above description assumes that the inner or outer surface of the faceplate is spherical, the invention can of course be applied to a case where the inner or outer surface of the faceplate is aspherical. In the case of an aspherical faceplate, as shown in FIG. 7, the equivalent radius of curvature RE is defined as follows by using an amount of droop Z from the center of the faceplate.

$$RE=(Z^2+d^2)/2Z$$

The advantage of the aspherical panel is the ability to set the panel thickness variation along the diagonal axis, along the major axis and along the minor axis individually for the required luminance setting value.

Figure 8:
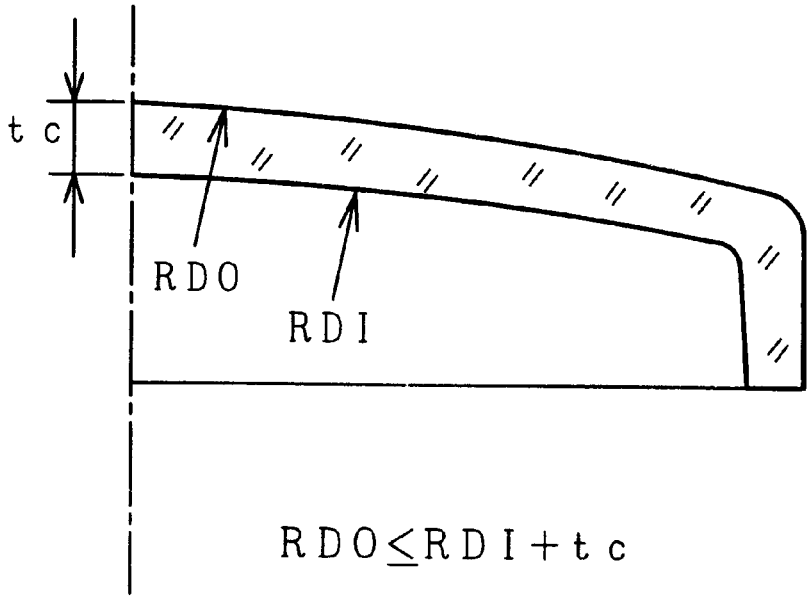
FIG. 8 is a cross section of the panel in another embodiment of this invention.
Figure 8:
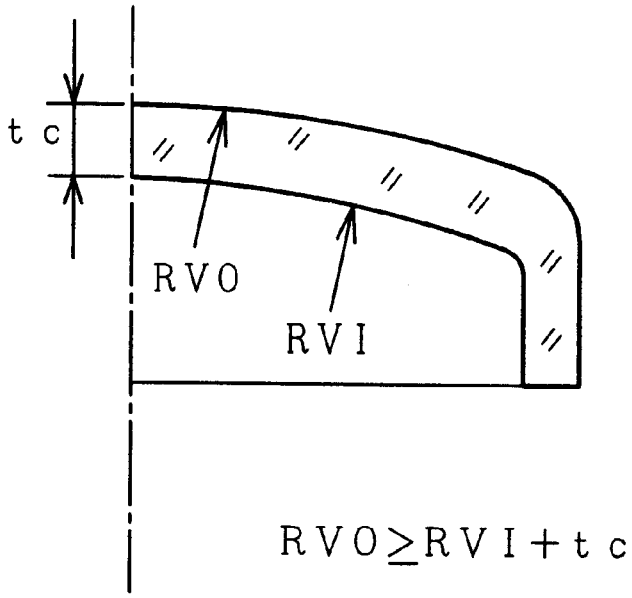

In the minor-axis direction peripheral areas 114, the brightness ratio with respect to the central area of the screen rarely becomes an issue. On the other hand, the shadow mask strength has the smallest margin in the minor-axis direction peripherals. The shadow mask strength can be increased by giving the shadow mask a curvature. The shadow mask curved surface is strongly influenced by the curvature of the panel inner surface. From this point of view, the radius of curvature of the panel inner surface should be set as small as possible. That is, the panel thickness in the diagonal direction peripheral areas is made smaller than that in the central area, and the panel thickness in the minor-axis direction peripheral areas is made larger than that in the central area. This can reduce the luminance difference between the central area and the peripheral area while maintaining the necessary strength of the shadow mask. An example of this embodiment is illustrated in FIG. 8.

Even when the panel thicknesses in the central and peripheral areas are almost equal, this invention can reduce the luminance difference between the central area and the peripheral area, compared with the prior art. In this case, it is desired that the black matrix hole transmittivity in the peripheral area of the screen be set to 70% or more, preferably 90% or more, of the hole transmittivity in the central area. It is also preferred that the black matrix hole transmittivity be set higher in the peripheral area than in the central area. When compared with the conventional panel whose thickness increases toward the diagonal direction peripheral areas, the panel with equal thicknesses can improve the luminance ratio to such an extent that the luminance difference can be maintained within a practically allowable range even when the black matrix hole transmittivity in the diagonal direction peripheral areas is 110% or less of that of the central area.

When the black matrix hole transmittivity in the peripheral area of the screen is equal to or less than 110% of that of the central area, it is possible to keep the dot pitch in the peripheral area at 110% or lower, so that a resolution deterioration in the peripheral area is hardly noticeable. Likewise, if the hole transmittivity in the peripheral area of the screen is 105% or less of that of the central area, the dot pitch in the peripheral area can be kept at 105% or less of that of the central area, making a resolution deterioration in the peripheral area nearly unnoticeable.

Figure 9:
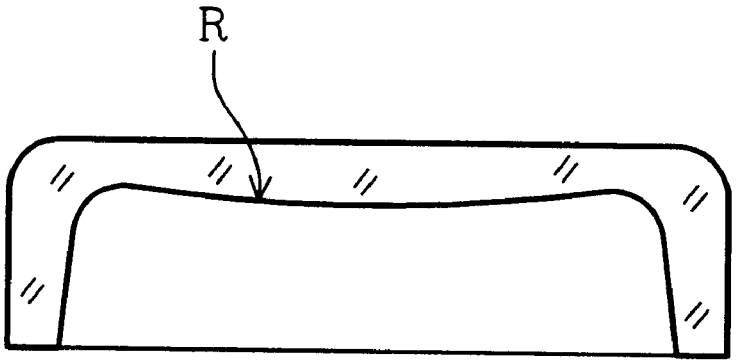
FIG. 9 is a cross section of the panel in a further embodiment of this invention.
Figure 9:
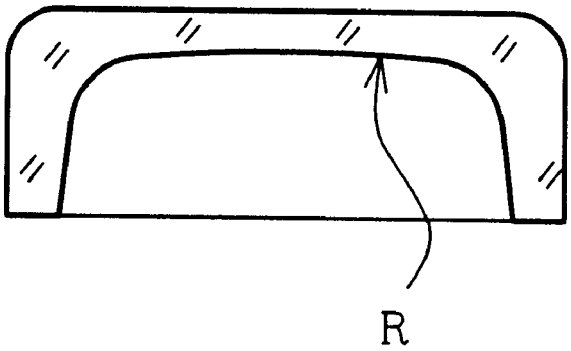

When the panel outer surface is flat, the panel inner surface of this invention is reverse-rounded in the diagonal direction as shown in FIG. 9. In this case, too, the inner surface may be reverse-rounded in the diagonal direction and positive-rounded in the minor-axis direction to minimize the luminance difference between the central area and the diagonal direction peripheral areas while maintaining the strength of the shadow mask.

When the panel inner surface is flat, the panel outer surface is given an appropriate curvature to reduce the luminance difference between the central area of the screen and the diagonal direction peripheral areas.

Figure 10:
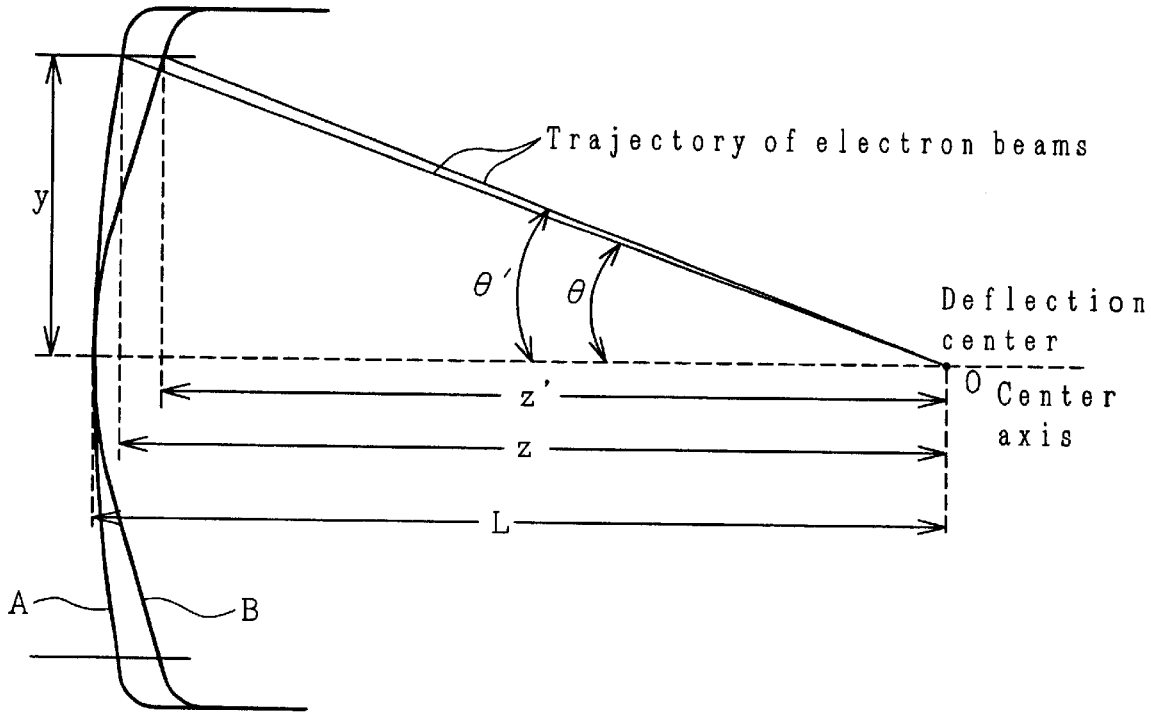
FIG. 10 is an explanatory diagram showing a virtual reduction in the deflection angle realized in this invention.
Figure 11:
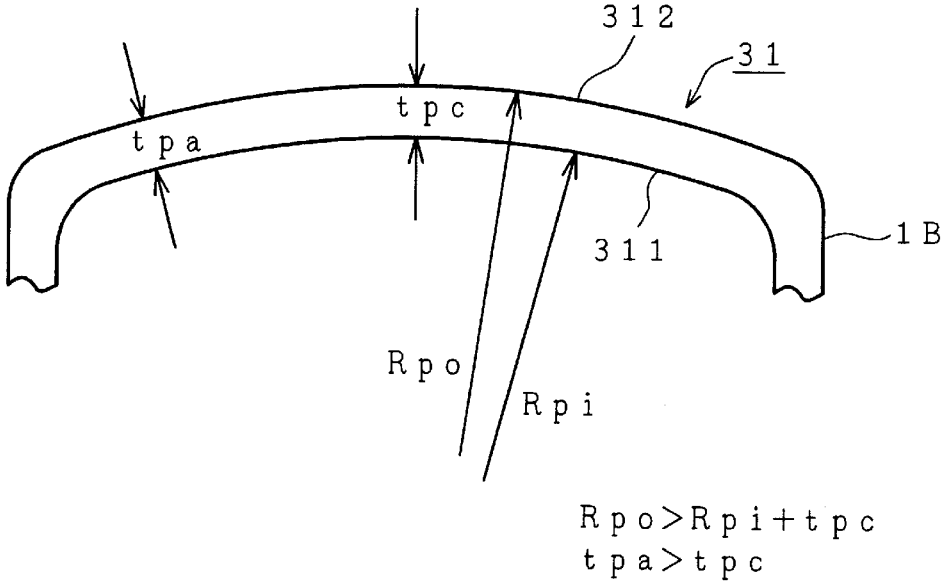
FIG. 11 (PRIOR ART)
FIG. 11 is a cross section of a panel as provided in a known cathode ray tube.

Next, FIG. 10 is a diagram showing the relation between the configuration of the faceplate inner surface 1A1 in the color cathode ray tube of the embodiment shown in FIG. 1 and the electron beam deflection angle. It also shows the relation between the configuration of the faceplate inner surface in the known cathode ray tube and the electron beam deflection angle. In the example of FIG. 10, the radius of curvature Ro of the faceplate outer surface in the color cathode ray tube of this embodiment and the radius of curvature Rpo of the faceplate outer surface in the known cathode ray tube are shown to be equal.

In FIG. 10, A represents a faceplate inner surface in the color cathode ray tube of this embodiment, B denotes a faceplate inner surface in the known cathode ray tube, and C denotes a center axis of an electron beam.

As shown in FIG. 10, in the color cathode ray tube of this embodiment, the electron beam 12 emitted from the electron gun 11 is deflected at the deflection center O of the electron beam 12 by the deflection yoke 7 before reaching the faceplate inner surface A. At this time, for the electron beam 12 to strike the faceplate inner surface A at a point a distance y from the electron beam center axis C, the electron beam deflection angle θ as defined below is required.

$$\theta = \tan^{-1}\frac{y}{z} \tag{1}$$

where z is the length of a locus of the electron beam 12 as projected onto the electron beam center axis C and can be expressed as $$z = L - R\cos\left\{\sin^{-1}\frac{y}{Ri}\right\}$$

where Ri is a radius of curvature of the faceplate inner surface A and L is a distance from the deflection center O of the electron beam 12 to the center of the faceplate inner surface A.

In the known cathode ray tube, on the other hand, the electron beam projected from the electron gun is deflected at the deflection center O of the electron beam by the deflection yoke before striking the faceplate inner surface B. At this time, for the electron beam to strike the faceplate inner surface B at a point a distance y from the electron beam center axis C, the electron beam deflection angle θ' as defined below is required.

$$\theta' = \tan^{-1}\frac{y}{z'} \tag{2}$$

where z' is the length of a locus of the electron beam 12 projected onto the electron beam center axis C and can be expressed as $$z' = L - R\cos\left\{\sin^{-1}\frac{y}{Rpi}\right\}$$

where Rpi is a radius of curvature of the faceplate inner surface A.

In this case, because the radius of curvature Ro of the faceplate outer surface in the color cathode ray tube of this embodiment and the radius of curvature Rpo of the faceplate outer surface in the known cathode ray tube are equal, a relation Ri>Rpi holds between the radius of curvature Ri of the faceplate inner surface in the color cathode ray tube of this embodiment and the radius of curvature Rpi of the faceplate inner surface in the known cathode ray tube. As a result, z>z'.

Applying this relation of z>z' to equation (1) and equation (2) results in a relation of θ<θ' where θ and θ' are electron beam deflection angles.

Because the deflection power supplied to the deflection yoke is proportional to the cube of the deflection angle, the deflection power can be reduced by an amount corresponding to a virtual reduction in the deflection angle. Hence, unwanted radiation from the deflection yoke can be reduced. Assuming that the deflection power may be set equal to the conventional level, the overall length of the cathode ray tube can be reduced by z–z'.

This invention is particularly effective for a cathode ray tube which has a large deflection angle, for example, a nominal deflection angle of 100° or greater, and thus places more stringent conditions on the deflection power.

With this invention, it is possible to reduce the luminance difference between the central area and the peripheral area of the screen while maintaining the landing margin in the peripheral area.

Further, with this invention, the luminance difference between the central area and the peripheral area of the screen can be reduced without reducing the strength of the shadow mask.

Further, with this invention, the deflection power can be reduced in the same aspect ratio of the screen, or the overall length of the cathode ray tube can be reduced.

What is claimed is:

1. A color cathode ray tube comprising:

a panel portion comprising a faceplate portion and a skirt portion, the faceplate portion having a screen to display an image, the panel portion having a shadow mask installed inside thereof;

a neck portion accommodating an electron gun therein; and a funnel portion connecting the panel portion and the neck portion;

wherein an outer surface of the faceplate portion is flat, a glass thickness of the screen of the panel portion in a diagonal direction peripheral are as of the screen is smaller than that of a central area of the screen, and a black matrix hole transmittivity in the diagonal direction peripheral areas of the screen of 90% to 110% of that of the central area of the screen.

2. A color cathode ray tube according to claim 1, wherein the black matrix hole transmittivity in the diagonal direction peripheral areas of the screen is smaller than that of the central area of the screen.

3. A color cathode ray tube according to claim 1, wherein the thickness of the screen of the panel portion in the minor-axis direction peripheral areas of the screen is equal to or larger than that of the central area of the screen.

4. A color cathode ray tube according to claim 1, wherein a dot pitch in the diagonal direction peripheral areas of the screen is 110% or less of that of the central area of the screen.

5. A color cathode ray tube according to claim 1, wherein the dot pitch in the diagonal direction peripheral areas of the screen is 105% or less of that of the central area of the screen.

6. A color cathode ray tube according to claim 1, wherein the black matrix hole transmittivity in the diagonal direction peripheral areas of the screen is equal to or greater than that of the central area of the screen.

7. A color cathode ray tube comprising:

a panel portion comprising a faceplate portion and a skirt portion, the faceplate portion having a screen to display an image, the panel portion having a shadow mask installed inside thereof;

a neck portion accommodating an electron gun therein; and a funnel portion connecting the panel portion and the neck portion;

wherein an inner surface of the faceplate portion is flat, a glass thickness of the screen of the panel portion in diagonal direction peripheral areas of the screen is smaller than that of a central area of the screen, and a black matrix hole transmittivity in the diagonal direction peripheral areas of the screen is 90% to 110% of that of the central area of the screen.

8. A color cathode ray tube according to claim 7, wherein the black matrix hole transmittivity in the diagonal direction peripheral areas of the screen is smaller than that of the central area of the screen.

9. A color cathode ray tube according to claim 7, wherein the black matrix hole transmittivity in the diagonal direction peripheral areas of the screen is equal to or greater than that of the central area of the screen.

* * * * *